US010605516B2

(12) United States Patent
Mitchell et al.

(10) Patent No.: US 10,605,516 B2
(45) Date of Patent: Mar. 31, 2020

(54) REFRIGERATOR APPLIANCE

(71) Applicant: Haier US Appliance Solutions, Inc., Wilmington, DE (US)

(72) Inventors: Alan Joseph Mitchell, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 117 days.

(21) Appl. No.: 15/905,871

(22) Filed: Feb. 27, 2018

(65) Prior Publication Data

US 2019/0264974 A1 Aug. 29, 2019

(51) Int. Cl.

| | |
|---|---|
| ***F25D 11/02*** | (2006.01) |
| ***F25D 17/06*** | (2006.01) |
| ***F25C 1/04*** | (2018.01) |
| ***F25C 5/20*** | (2018.01) |
| ***F25C 5/182*** | (2018.01) |

(52) U.S. Cl.

CPC ..... *F25D 11/022* (2013.01); *F25C 1/04* (2013.01); *F25C 5/182* (2013.01); *F25C 5/22* (2018.01); *F25D 17/065* (2013.01)

(58) Field of Classification Search

CPC ..... F25D 11/022; F25D 17/065; F25C 5/182
See application file for complete search history.

(56) References Cited

U.S. PATENT DOCUMENTS

| | | | | |
|---|---|---|---|---|
| 2,728,203 | A | 12/1955 | King | |
| 6,694,770 | B2 | 2/2004 | Winders et al. | |
| 6,725,678 | B2 | 4/2004 | Chang et al. | |
| 7,036,334 | B2 | 5/2006 | Ko et al. | |
| 7,059,142 | B2 | 6/2006 | Jeong et al. | |
| 7,762,102 | B2 | 7/2010 | Hamel et al. | |
| 8,814,284 | B2 | 8/2014 | Lee et al. | |
| 9,170,045 | B2 * | 10/2015 | Oh | F25D 23/02 |
| 9,353,983 | B2 | 5/2016 | Mitchell et al. | |
| 9,995,077 | B2 * | 6/2018 | Hwang | E05F 5/06 |
| 2012/0031129 | A9 | 2/2012 | Tarr et al. | |
| 2017/0248348 | A1 * | 8/2017 | Kim | F25B 41/067 |
| 2019/0003758 | A1 * | 1/2019 | Scalf | F25D 21/002 |

FOREIGN PATENT DOCUMENTS

| | | |
|---|---|---|
| KR | 101187121 | 9/2012 |
| WO | WO2009072773 A2 | 6/2009 |

* cited by examiner

*Primary Examiner* — Ana M Vazquez
(74) *Attorney, Agent, or Firm* — Dority & Manning, P. A.

(57) ABSTRACT

A refrigerator appliance includes a cabinet that defines a fresh food chamber and a freezer chamber. A door is rotatably mounted to the cabinet at a front portion of the fresh food storage chamber. The door includes an outer casing. The outer casing includes a thermally insulated wall that defines a flexible chamber. The door also includes a front panel rotatably mounted to the outer casing such that the front panel permits access to the flexible chamber when the door is in the closed position. The refrigerator appliance also includes a sealed cooling system. The sealed cooling system includes a first evaporator in fluid communication with the flexible chamber and the fresh food chamber. The sealed system also includes a second evaporator in fluid communication with the freezer chamber.

16 Claims, 7 Drawing Sheets

REFRIGERATOR APPLIANCE

FIELD OF THE INVENTION

The present disclosure relates generally to refrigerator appliances.

BACKGROUND OF THE INVENTION

Refrigerator appliances generally include a cabinet that defines chilled chambers for receipt of food items for storage. One or more insulated, sealing doors are provided for selectively enclosing the chilled food storage chambers. Consumers generally prefer chilled chambers that facilitate visibility and accessibility of food items stored therein.

In certain refrigerator appliances, commonly referred to as side-by-side style refrigerator appliance, the fresh food chamber is positioned next to the fresh food chamber within the cabinet. Such a configuration can permit easy access to food items stored on doors of the refrigerator appliances. However, the cabinet can be deep and narrow such that accessing food items at a back of the fresh food chamber and/or freezer chamber is difficult.

In other refrigerator appliances, commonly referred to as bottom mount refrigerator appliances, the freezer chamber is positioned below the fresh food chamber in the cabinet. Such a configuration can provide a wide fresh food chamber and/or a wide freezer chamber. However, a depth of the fresh food chamber and the freezer chamber can make accessing food items at a back of the refrigerator appliance difficult.

Accordingly, a refrigerator appliance with features for assisting with accessing food items stored therein would be useful.

BRIEF DESCRIPTION OF THE INVENTION

A refrigerator appliance includes a cabinet with a door rotatably mounted to the cabinet. The door defines a flexible chamber therein. A front panel is rotatably mounted to the door such that the front panel of the door permits access to the flexible chamber when the door is in a closed position. Additional aspects and advantages of the invention will be set forth in part in the following description, or may be apparent from the description, or may be learned through practice of the invention.

In an exemplary embodiment, a refrigerator appliance is provided. The refrigerator appliance defines a vertical direction, a lateral direction and a transverse direction. The vertical, lateral and transverse directions are mutually perpendicular. The refrigerator appliance includes a cabinet extending from a top to a bottom along the vertical direction. The cabinet also extends from a left side to a right side along the lateral direction. The cabinet defines a fresh food chamber. The fresh food chamber extends along the vertical direction between the top and bottom of the cabinet, along the lateral direction between the left side and the right side of the cabinet, and along the transverse direction between a front portion and a back portion. The front portion of the fresh food storage chamber defines an opening for receipt of food items. The cabinet also defines a freezer chamber extending along the vertical direction between the top and bottom of the cabinet and spaced apart from the fresh food chamber along the vertical direction. A door is rotatably mounted to the cabinet at the front portion of the fresh food storage chamber such that the door rotates between a closed position where the door sealingly encloses the fresh food storage chamber and an open position to permit access to the fresh food chamber. The door includes an outer casing comprising a thermally insulated wall that defines a flexible chamber and a front panel rotatably mounted to the outer casing of the door such that the front panel of the door permits access to the flexible chamber when the door is in the closed position. The refrigerator appliance also includes a sealed system configured for generating chilled air. The sealed system is in fluid communication with the fresh food chamber, the freezer chamber, and the flexible chamber to provide the chilled air to the fresh food chamber, the freezer chamber, and the flexible chamber. The sealed system includes a compressor and a first evaporator. The first evaporator is in fluid communication with the flexible chamber and is in fluid communication with the fresh food chamber. The sealed system also includes a second evaporator in fluid communication with the freezer chamber and a fan positioned adjacent the first evaporator.

In another exemplary embodiment, a refrigerator appliance is provided. The refrigerator appliance defines a vertical direction. The refrigerator appliance includes a cabinet extending from a top to a bottom along the vertical direction. The cabinet defines a fresh food chamber. The fresh food chamber extends along the vertical direction between the top and bottom of the cabinet. The fresh food chamber also extends between a front portion and a back portion. The front portion of the fresh food storage chamber defines an opening for receipt of food items. The cabinet also defines a freezer chamber extending along the vertical direction between the top and bottom of the cabinet and spaced apart from the fresh food chamber along the vertical direction. A door is rotatably mounted to the cabinet at the front portion of the fresh food storage chamber such that the door rotates between a closed position where the door sealingly encloses the fresh food storage chamber and an open position to permit access to the fresh food chamber. The door includes an outer casing comprising a thermally insulated wall that defines a flexible chamber and a front panel rotatably mounted to the outer casing of the door such that the front panel of the door permits access to the flexible chamber when the door is in the closed position. The refrigerator appliance also includes a sealed system configured for generating chilled air. The sealed system is in fluid communication with the fresh food chamber, the freezer chamber, and the flexible chamber to provide the chilled air to the fresh food chamber, the freezer chamber, and the flexible chamber. The sealed system includes a compressor and a first evaporator. The first evaporator is in fluid communication with the flexible chamber and is in fluid communication with the fresh food chamber. The sealed system also includes a second evaporator in fluid communication with the freezer chamber and a fan positioned adjacent the first evaporator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
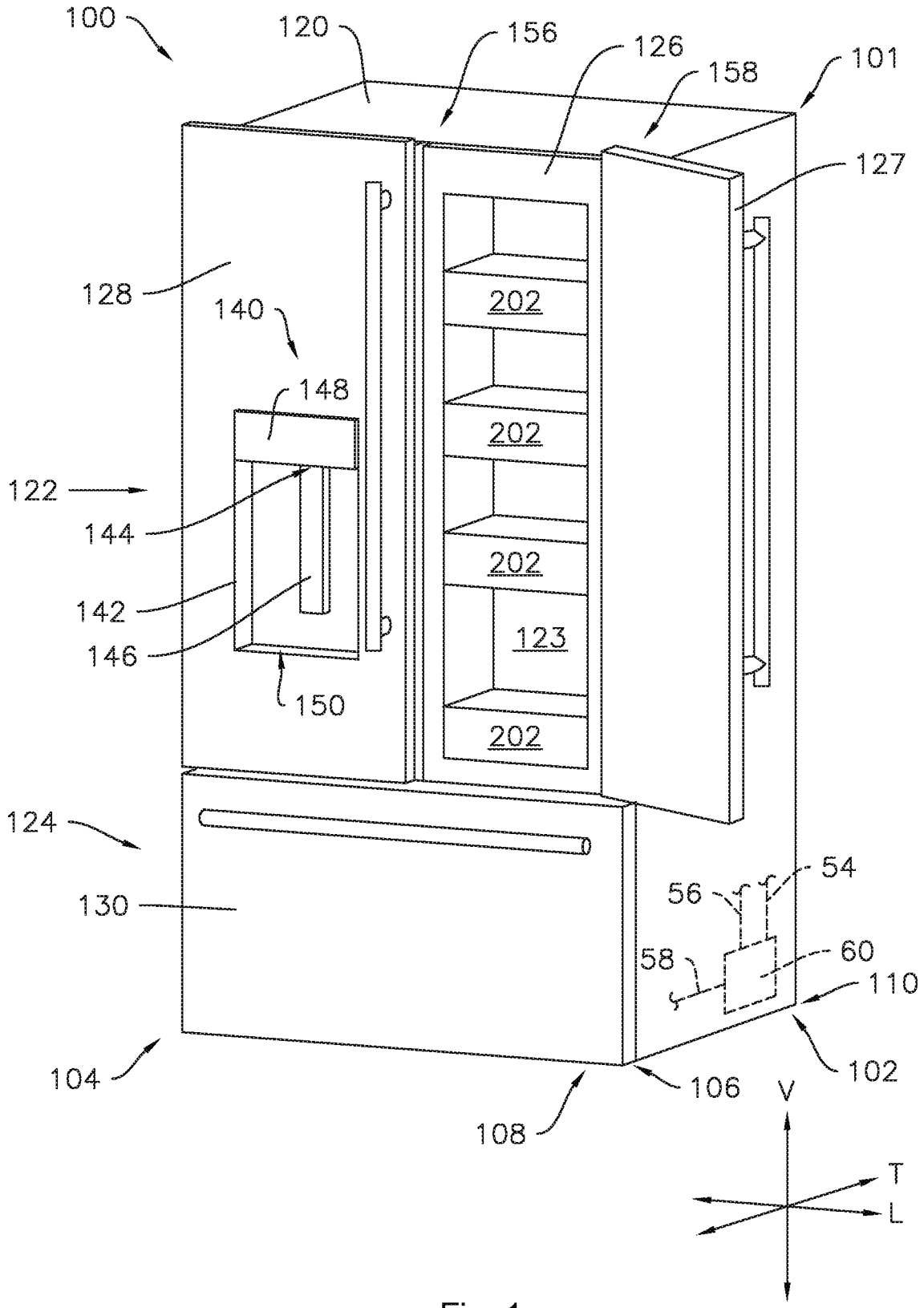
FIG. 1 provides a perspective view of an exemplary refrigerator appliance according to one or more embodiments of the present subject matter with a front panel of a door in an open position while the door is in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees either clockwise or counterclockwise with the vertical direction V.

Figure 3:
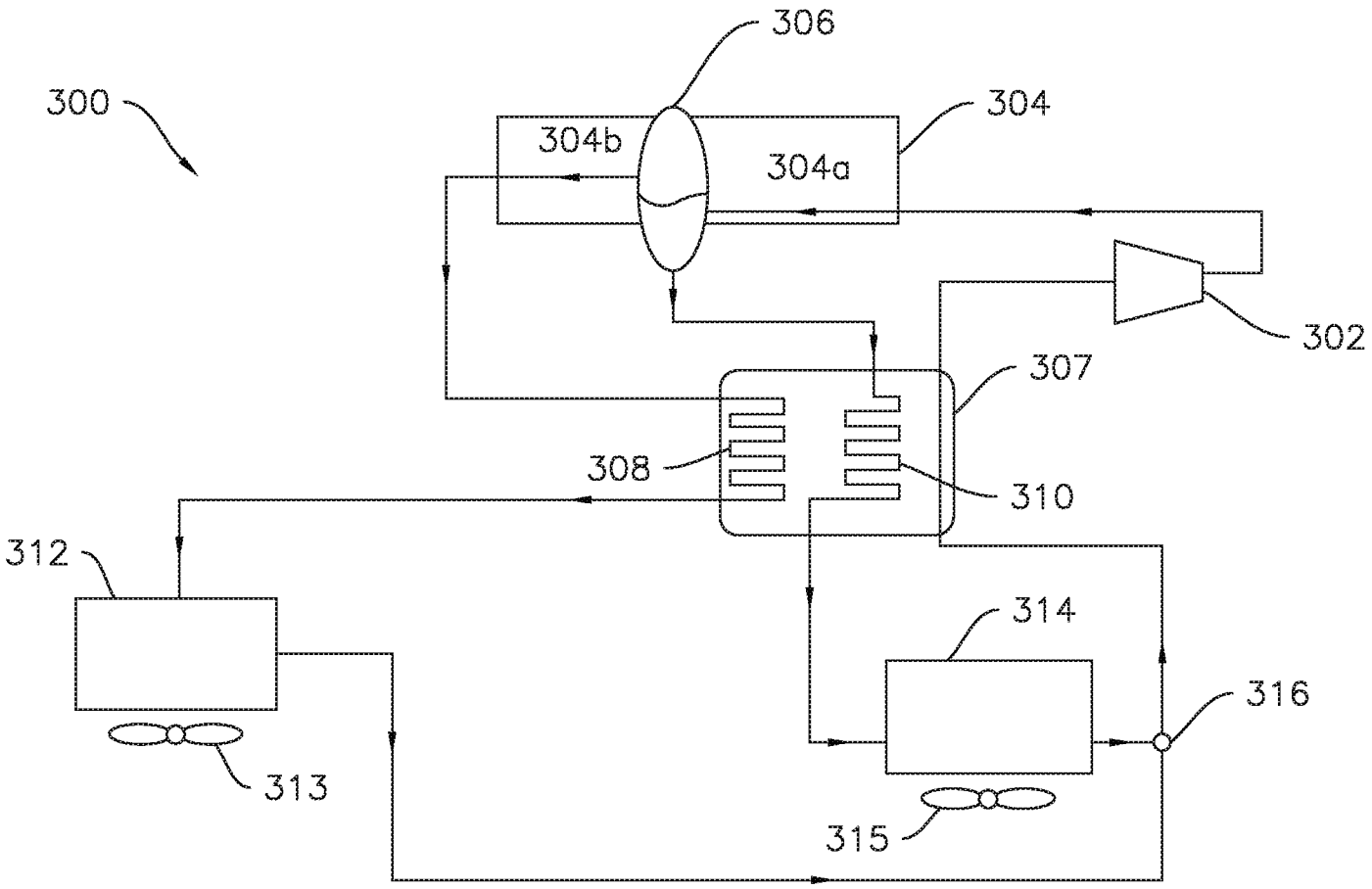
FIG. 3 is a schematic diagram of an exemplary refrigeration system as may be used with the present subject matter.

FIG. 1 provides a perspective view of an exemplary refrigerator appliance 100 according to one or more embodiments of the present subject matter. Refrigerator appliance 100 defines a vertical direction V, a lateral direction L, and a transverse direction T, each mutually perpendicular to one another. As may be seen in, e.g., FIG. 1, refrigerator appliance 100 includes a cabinet or housing 120 that extends between a top 101 and a bottom 102 along a vertical direction V, between a left side 104 and a right side 106 along the lateral direction L, and between a front 108 and a rear 110 along the transverse direction T. Housing 120 defines chilled chambers for receipt of food items for storage. In the exemplary embodiment, housing 120 also defines a mechanical compartment 60 at or near the bottom 102 of the cabinet 120 for receipt of a sealed cooling system, such as the dual evaporator system 300 illustrated in FIG. 3. One or more ducts, e.g., ducts 54, 56, and 58 as illustrated for example in FIG. 1 and described in more detail below, may extend between the mechanical compartment 60 and the chilled chambers to provide fluid communication therebetween, e.g., to provide chilled air from the sealed cooling system to one or more of the chilled chambers. In particular, housing 120 defines a fresh food chamber 122 and a freezer chamber 124 spaced apart from the fresh food chamber 122 along the vertical direction V. As may be seen in FIGS. 5-7, the freezer chamber 124 and the fresh food chamber 122 may be separated by a thermally insulated partition 200. For example, in the illustrated embodiment of FIG. 1, fresh food chamber 122 is positioned at or adjacent top 101 of housing 120 and freezer chamber 124 is arranged at or adjacent bottom 102 of housing 120. As such, refrigerator appliance 100 is generally referred to as a bottom mount refrigerator. It is recognized, however, that the benefits of the present disclosure may apply to other types and styles of refrigerator appliances such as, e.g., a top mount refrigerator appliance, or a side-by-side style refrigerator appliance. Consequently, the description set forth herein is for illustrative purposes only and is not intended to be limiting in any aspect to any particular refrigerator chamber configuration.

As shown for example in FIGS. 1, 2, 6, and 7, various storage components are mounted within fresh food chamber 122 and flexible chamber 123 to facilitate storage of food items therein as will be understood by those skilled in the art. In particular, the storage components may include various combinations of bins 202, drawers 204, and shelves 206 mounted within fresh food chamber 122 and flexible chamber 123. Bins 202, drawers 204, and shelves 206 are configured for receipt of food items (e.g., beverages and/or solid food items) and may assist with organizing such food items.

Figure 2:
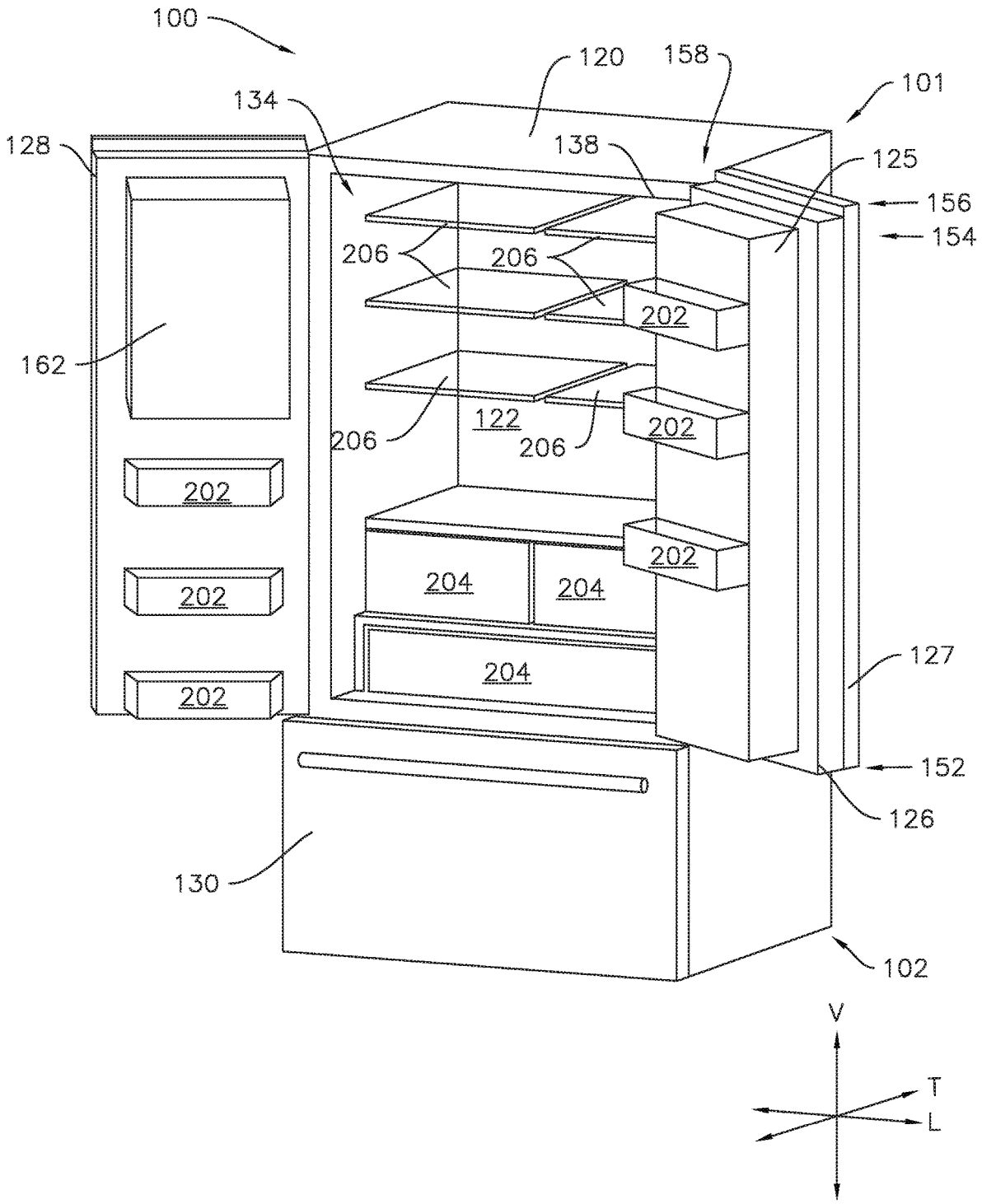
FIG. 2 provides a perspective view of the refrigerator appliance of FIG. 1 with a first fresh food chamber door and a second fresh food chamber door both in an open position.
Figure 6:
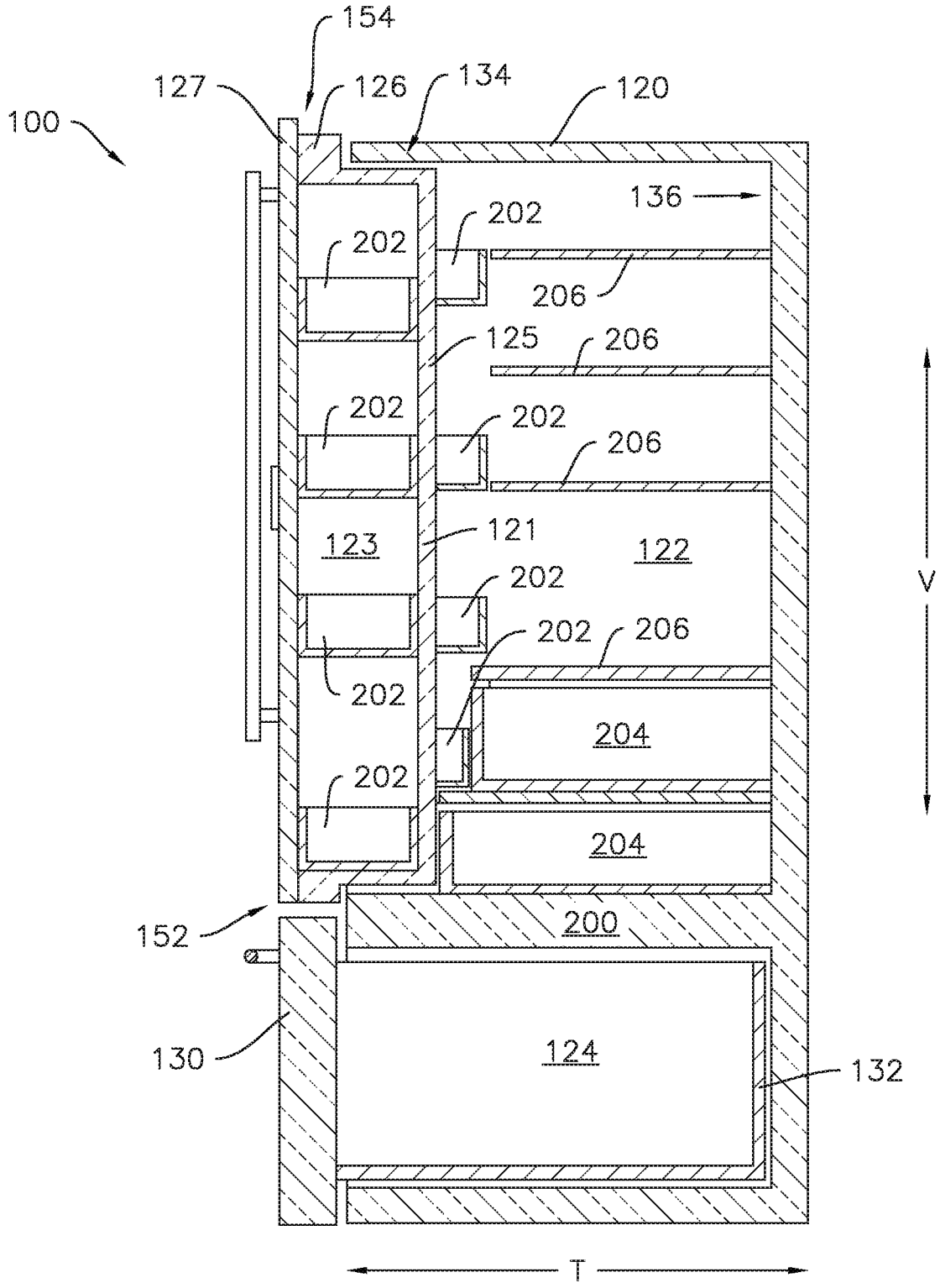
FIG. 6 provides a right side section view of the refrigerator appliance of FIG. 1.

As may be seen in FIG. 2, the fresh food chamber 122 extends along the vertical direction V between the top 101 and the bottom 102 of the cabinet 120 and along the lateral direction L between the left side 104 and the right side 106 of the cabinet 120. The fresh food chamber 122 also extends along the transverse direction T between a front portion 134 and a back portion 136 (FIG. 6). The front portion 134 of the fresh food storage chamber 122 defines an opening 138 for receipt of food items.

Refrigerator doors 126 and 128 are rotatably mounted, e.g., hinged, to an edge of housing 120 for selectively accessing fresh food chamber 122. Since refrigerator doors 126 and 128 correspond to the fresh food chamber 122, the refrigerator doors 126 and 128 may also be referred to as fresh food chamber doors. Refrigerator doors 126 and 128 may be mounted to the housing 120 at or near the front portion 134 of the fresh food storage chamber 122 such that the doors 126 and 128 rotate between a closed position (FIG. 1) where the doors 126 and 128 cooperatively sealingly enclose the fresh food storage chamber 122 and an open position (FIG. 2) to permit access to the fresh food chamber 122. The doors 126 and 128 may be generally mirrored, e.g., the overall shape and size of each door 126, 128 may be the same as the other door 126, 128, with possible internal variations such as the dispenser recess 150 described below. In addition, a freezer door 130 is arranged below refrigerator doors 126 and 128 for selectively accessing freezer chamber 124. Freezer door 130 is coupled to a freezer drawer 132 (FIGS. 6 and 7) slidably mounted within freezer chamber 124. Refrigerator doors 126, 128 and freezer door 130 are shown in the closed configuration in FIG. 1. One of the refrigerator doors, e.g., right door 126 as in the illustrated example, may include an outer casing 121 (FIG. 6) comprising a thermally insulated wall 125 (FIG. 2) that defines a flexible chamber 123 and a front panel 127 rotatably mounted to the outer casing 121 of the door 126 such that the front panel 127 permits access to the flexible chamber 123 when the door 126 is in the closed position, as shown for example in FIG. 1.

Still with reference to FIG. 1, refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 126 and 128, such as left door 128 as in the illustrated exemplary embodiment. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned on an exterior side of one of the refrigerator doors 126 and 128, e.g., exterior side 129 (FIG. 7) of left door 128 as in the illustrated example embodiment, at a predetermined elevation convenient for a user to access ice or water and enabling the user to access ice without the need to bend-over and without the need to open doors 126 and 128. In the exemplary embodiment, dispenser recess 150 is positioned at a level that approximates the chest level of a user.

As mentioned above, refrigerator appliance 100 generally includes a sealed cooling system disposed in mechanical compartment 60 (FIG. 1) and configured for generating chilled air. For example, in some embodiments, the refrigerator appliance 100 may include a dual evaporator cooling system, such as the exemplary system 300 illustrated in FIG. 3. The cooling system 300 is charged with a refrigerant. For example, in some embodiments the refrigerant may be a zeotropic refrigerant mixture. As shown, the example refrigeration system 300 illustrated in FIG. 3 includes a compressor 302 and a condenser 304. Condenser 304 includes a first portion 304*a* and a second portion 304*b*. A phase separating component 306 may, in some embodiments, be connected to condenser 304 between the first and second portions 304*a* and 304*b*, e.g., in embodiments wherein the refrigerant is a zeotropic refrigerant mixture. The exemplary refrigeration system 300 illustrated in FIG. 3 also has a set of pressure reducing devices 307 including a first reducer 308 and a second reducer 310.

In embodiments which include the dual evaporator cooling system 300, the system 300 may include a first evaporator 314 which operates with a first evaporator fan 315 adjacent the first evaporator 314 and second evaporator 312 which operates with a second evaporator fan 313 adjacent the second evaporator 312. In such embodiments, the first evaporator 314 may be mounted to the cabinet 120 adjacent the fresh food chamber 122. A refrigerant stream union point 316 may be positioned downstream of the evaporators 312 and 314. For this exemplary embodiment, expansion or reducing devices 308 and 310 can be configured as capillary tubes positioned between the condenser 304 and evaporators 312 and 314 as shown.

Figure 4:
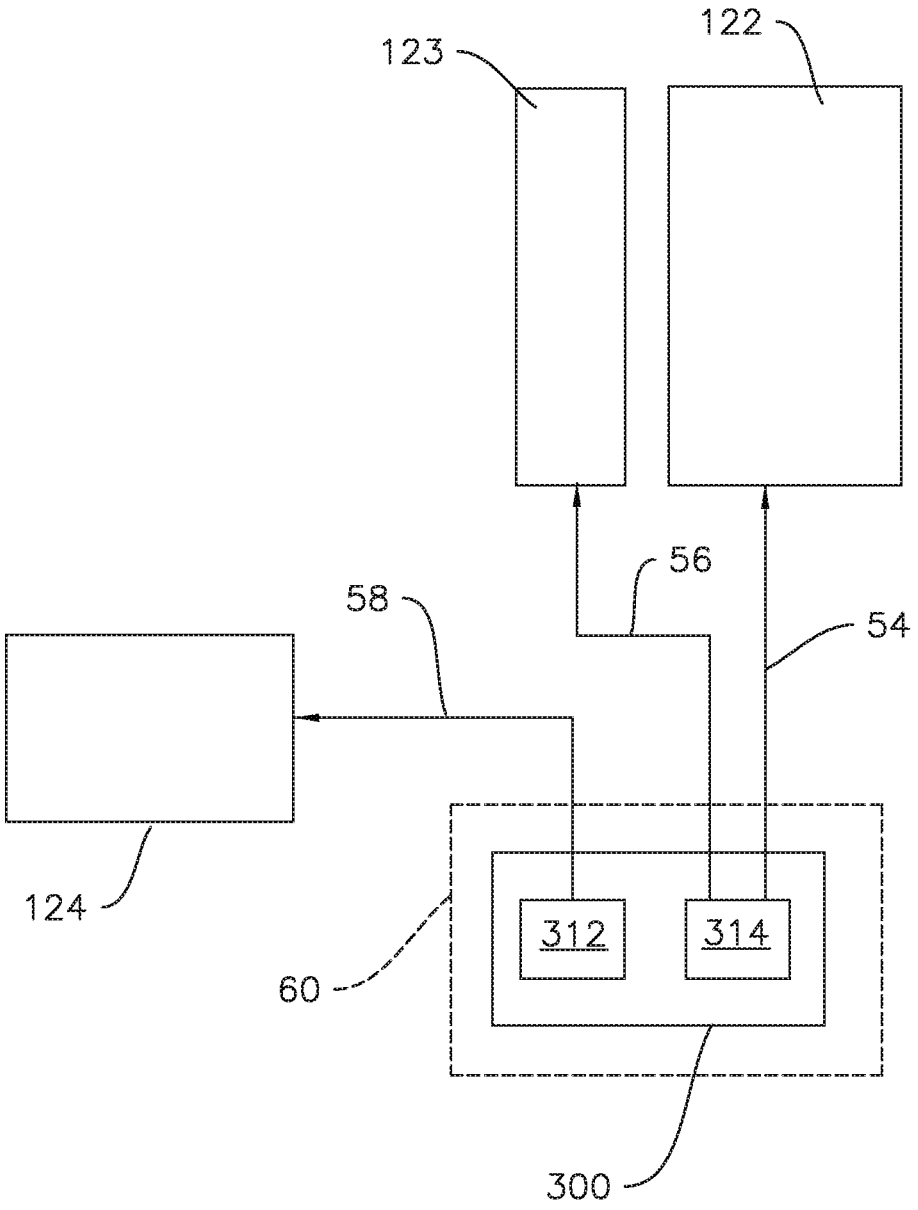
FIG. 4 is a schematic diagram of an exemplary chilled air distribution system as may be used with the present subject matter.

As shown in FIG. 4, the sealed system 300 may be in fluid communication with the fresh food chamber 122, the freezer chamber 124, and the flexible chamber 123 to provide the chilled air to the fresh food chamber 122, the freezer chamber 124, and the flexible chamber 123 separately or in various combinations. In particular, the first evaporator 314 may be in fluid communication with the flexible chamber 123 and the fresh food chamber 122 and the second evaporator 312 may be in fluid communication with the freezer chamber 124. The first evaporator 314 may be only in fluid communication with the fresh food chamber 122 and the flexible chamber 123 and not in fluid communication with the freezer chamber 124. The second evaporator 312 may be a dedicated freezer evaporator, e.g., the second evaporator 312 may be only in fluid communication with the freezer chamber 124 and not in fluid communication with the fresh food chamber 122 or the flexible chamber 123. For example, as illustrated in FIG. 4, a first duct 54 may extend between and provide fluid communication from the first evaporator 314 to the fresh food chamber 122 and a second duct 56 may extend between and provide fluid communication from the first evaporator 314 to the flexible chamber 123. In some embodiments, the first duct 54 and the second duct 56 may be mutually isolated, e.g., via a damper (not shown) or other suitable mechanism. In such embodiments, the fresh food chamber 122 and the flexible chamber 123 may be not in fluid communication, for example, in addition to the ducts 54 and 56 being mutually isolated from each other, the thermally insulated wall 125 may be a solid and continuous wall in all direction with no openings, e.g., vents, louvers, etc., therein.

In various embodiments, the fresh food chamber 122 may be selectively operable within a first temperature range and the flexible chamber 123 may be selectively operable within a second temperature range wider than the first temperature range. Such distinct temperatures may be provided, for example, by using a damper to selectively direct chilled air from first evaporator 314 to only one of the fresh food chamber 122 and the flexible chamber 123. For example, the flexible chamber 123 may be operable at a temperature lower than the temperature of the fresh food chamber 122, including temperatures at or below the freezing point of water, such that the flexible chamber 123 may serve as an in-door freezer chamber. Thus, the freezer chamber 124 may be relatively smaller than typical similarly-configured refrigerator appliances, such as typical bottom-mount refrigerators, without significantly reducing the total storage volume within the refrigerator appliance 100 available for frozen items. Additionally, when the flexible chamber 123 provides frozen storage, a user may be able to access frozen items therein without having to bend over to reach into freezer drawer 132. For example, the flexible chamber 123 may be operable at a temperature lower than the temperature of the fresh food chamber 122 by closing or obstructing first duct 54, e.g., with a damper, to direct a larger proportion or an entirety of chilled air from first evaporator 314 to the flexible chamber 123 rather than the fresh food chamber 122. As another example, the flexible chamber 123 may be operable at a temperature higher than the temperature of the fresh food chamber 122, such as for chilling wine, certain vegetables, etc. The flexible chamber 123 may be operable at a temperature higher than the temperature of the fresh food chamber 122 by, for example, closing or obstructing second duct 56, e.g., with a damper, to direct a larger proportion or an entirety of chilled air from first evaporator 314 to the fresh food chamber 122 rather than the flexible chamber 123.

For example, the first temperature range of the fresh food chamber 122 may be between approximately thirty-three degrees Fahrenheit (33° F.) and approximately forty (40° F.) degrees Fahrenheit, such as between approximately thirty-five degrees Fahrenheit (35° F.) and approximately thirty-eight degrees Fahrenheit (38° F.). Also by way of example, the second temperature range may include temperatures less than thirty-two degrees Fahrenheit (32° F.), such as about ten degrees Fahrenheit (10° F.), such as about zero degrees Fahrenheit (0° F.), and temperatures greater than forty degrees Fahrenheit (40° F.), such as about forty-five degrees Fahrenheit (45° F.), such as about sixty degrees Fahrenheit (60° F.). Still further, it should be understood that fresh food chamber 122 and flexible chamber 123 may be selectively operable at any number of various temperatures and/or temperature ranges as desired or required per application.

Figure 5:
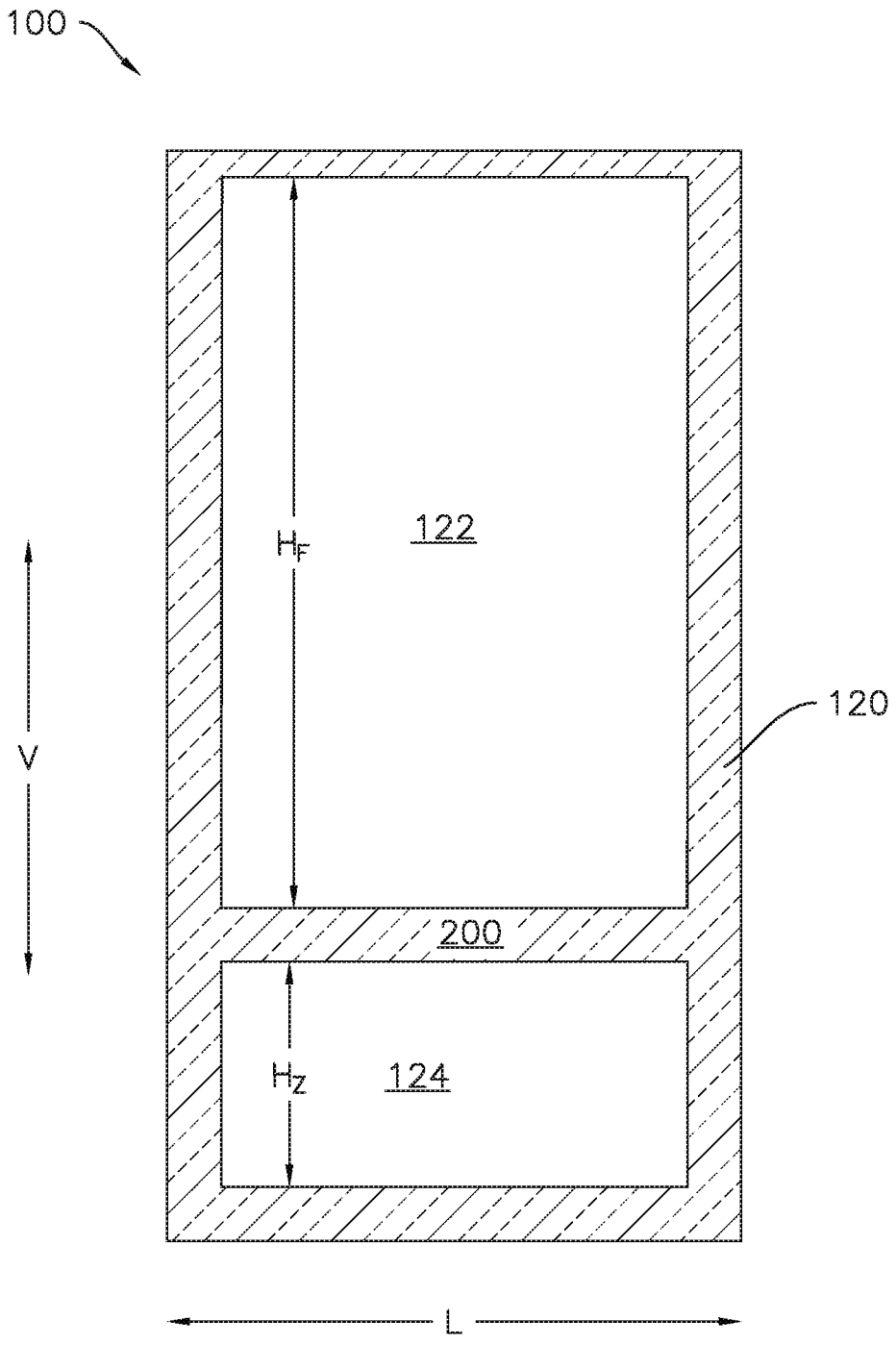
FIG. 5 provides a front section view of the refrigerator appliance of FIG. 1.

FIG. 5 provides a front section view of refrigerator appliance 100, in particular, cabinet 120 of refrigerator appliance 100 including fresh food chamber 122 and freezer chamber 124. As may be seen in FIG. 5, the freezer chamber 124 defines a height $H_Z$ along the vertical direction V and the fresh food chamber 122 defines a height $H_F$ along the vertical direction V. In various embodiments, the height $H_F$ of the fresh food chamber 122 may be approximately three times the height $H_Z$ of the freezer chamber 124. For example, the height $H_F$ of the fresh food chamber 122 may be about forth-five inches (45") and the height $H_Z$ of the freezer chamber 124 may be about fifteen inches (15"). As noted above, the flexible chamber 123 may be operable within a low temperature range as compared to the fresh food chamber 122, and/or at or about the same temperature as the freezer compartment 124, such that the relatively small size of the freezer chamber 124 is supplemented by additional frozen food storage within one of the refrigerator doors 126 and 128.

As best seen in FIGS. 1, 2, and 6, the flexible chamber 123 and the door 126 may be generally coextensive. For example, as seen in FIG. 6, the flexible chamber 123 and the door 126 may be generally coextensive along the vertical direction, e.g. a vertical height of the flexible chamber 123 may be about the same (excepting the thickness of the thermally insulated walls defining the flexible chamber 123) as a vertical height of the door 126. The flexible chamber 123 may extend along the vertical direction V from a bottom 152 of the door 126 to a top 154 of the door 126. The flexible chamber 123 and the door 126 may also be generally coextensive along a direction perpendicular to the vertical direction V, e.g., at least one of the lateral direction L and the transverse direction T, e.g., depending on the orientation of the door 126, e.g. whether the door 126 is in the closed position or the open position. For example, the door 126 may extend between a left side 156 and a right side 158, e.g., along the lateral direction L when the door 126 is in the closed position, as illustrated in FIG. 1. In such embodiments, the flexible chamber 123 may extend from the left side 156 of the door 126 to the right side 158 of the door 126 such that the flexible chamber 123 is generally coextensive with the door 126 along a direction perpendicular to the vertical direction V, e.g., the lateral direction L.

Figure 7:
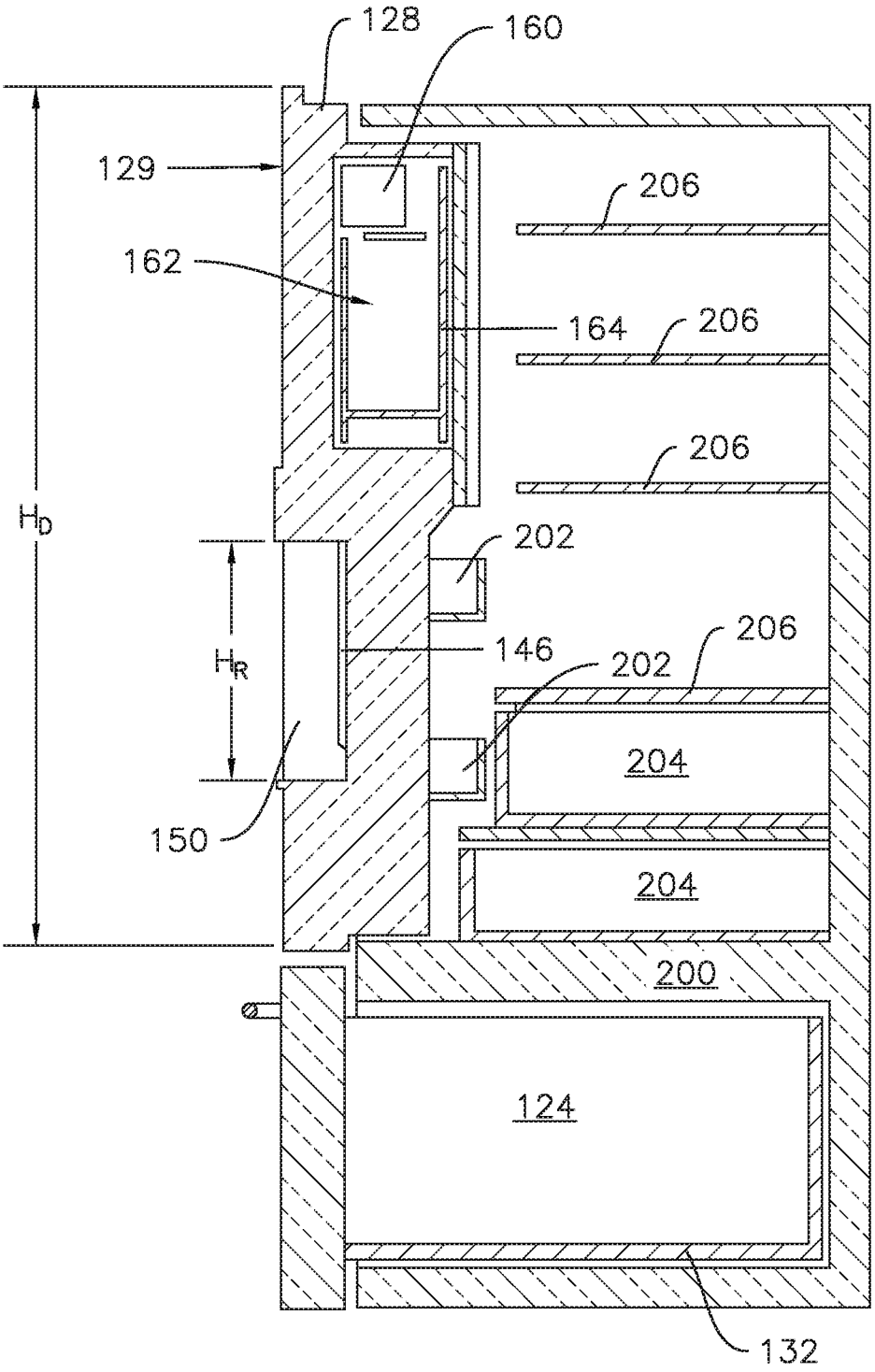
FIG. 7 provides a left side section view of the refrigerator appliance of FIG. 1.

FIG. 7 provides a section view taken through second fresh food chamber door 128. As may be seen in FIG. 7, refrigerator appliance 100 includes a sub-compartment 162 defined on second fresh food chamber door 128. Sub-compartment 162 may be referred to as an "icebox." Sub-compartment 162 extends into fresh food chamber 122 when second fresh food chamber door 128 is in the closed position. An ice maker or ice making assembly 160 and an ice storage bin or ice bucket 164 are positioned or disposed within sub-compartment 162. The ice making assembly 160 may be configured to form ice pieces within the ice making assembly 160. The ice making assembly 160 may be in communication with the ice bucket 164 such that ice pieces formed in the ice making assembly 160 may be transferred to and stored in the ice bucket 164. Thus, ice is supplied to dispenser recess 150 from the ice bucket 164 in sub-compartment 162 on a back side of second fresh food chamber door 128.

As illustrated in FIG. 7, the left refrigerator door 128 defines a height $H_D$ along the vertical direction V and the dispenser recess 150 extends along the vertical direction V between the ice box 162, in particular a dispenser chute thereof, and a bottom of the door 128. As such, the dispenser recess 150 defines a height $H_R$ along the vertical direction V. In various example embodiments, the height $H_R$ of the dispenser recess 150 may be at least about one-quarter of the height $H_D$ of the left refrigerator door 128, such as about one-third of the height $H_D$ of the left refrigerator door 128 or greater. For example, in some embodiments, the height $H_R$ of the dispenser recess 150 may be about eight inches (8") or greater, such as about ten inches (10") or greater, such as about twelve inches (12") or greater, such as about sixteen inches (16") or greater. The height $H_D$ of the left refrigerator door 128 is about the same as the height $H_F$ of the fresh food chamber 122. Thus, for example, in embodiments where the height $H_F$ of the fresh food chamber 122 is about forty-five inches (45"), the height $H_R$ of the dispenser recess 150 may be about one-third of the height $H_D$ of the left refrigerator door 128, e.g., about fifteen inches (15").

The present disclosure, in various embodiments, provides several advantages. For instance, access to frozen items may be improved when the flexible chamber 123 is used as a freezer chamber. In such instances, larger frozen items may be stored in the freezer chamber 124 and smaller items may be stored separately in the flexible chamber 123 such that the smaller items are readily accessible and are less likely to become buried under or obstructed by larger items in a single freezer chamber. As another example, the present disclosure provides an overall larger, e.g., greater volume of, the fresh food chamber 122 as compared to more conventional designs. As such, the available space for keeping fresh food items may be increased. Such increased volume of the fresh food chamber 122 may also advantageously permit a larger, e.g., taller, dispenser recess 150 in one of the fresh food chamber doors, e.g., as described above. In another example, the increased volume of the fresh food chamber 122 may also or instead advantageously permit a larger, e.g., deeper, ice box 162 with increased ice storage capacity.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction and a transverse direction, the vertical, lateral and transverse directions being mutually perpendicular, the refrigerator appliance comprising:

a cabinet extending from a top to a bottom along the vertical direction, the cabinet also extending from a left side to a right side along the lateral direction, the cabinet defining a fresh food chamber, the fresh food chamber extending along the vertical direction between the top and the bottom of the cabinet, along the lateral direction between the left and right sides of the cabinet, and along the transverse direction between a front portion and a back portion, the front portion of the fresh food storage chamber defining an opening for receipt of food items, the cabinet also defining a freezer chamber extending along the vertical direction between the top and bottom of the cabinet and spaced apart from the fresh food chamber along the vertical direction;

a door rotatably mounted to the cabinet at the front portion of the fresh food storage chamber such that the door rotates between a closed position where the door sealingly encloses the fresh food storage chamber and an open position to permit access to the fresh food chamber, the door comprising an outer casing comprising a thermally insulated wall that defines a flexible chamber and a front panel rotatably mounted to the outer casing of the door such that the front panel of the door permits access to the flexible chamber when the door is in the closed position;

a sealed system configured for generating chilled air, the sealed system in fluid communication with the fresh food chamber, the freezer chamber, and the flexible chamber to provide the chilled air to the fresh food chamber, the freezer chamber, and the flexible chamber, the sealed system comprising a compressor, a first evaporator in fluid communication with the flexible chamber and in fluid communication with the fresh food chamber, a second evaporator in fluid communication with the freezer chamber, and a fan positioned adjacent the first evaporator;

a first duct providing fluid communication from the first evaporator to the fresh food chamber; and a second duct providing fluid communication from the first evaporator to the flexible chamber, wherein the first duct and the second duct are mutually isolated, and wherein the fresh food chamber and the flexible chamber are not in fluid communication.

2. The refrigerator appliance of claim 1, wherein the freezer chamber defines a height along the vertical direction, the fresh food chamber defines a height along the vertical direction, and wherein the height of the fresh food chamber is approximately three times the height of the freezer chamber.

3. The refrigerator appliance of claim 1, wherein the fresh food chamber is selectively operable within a first temperature range and the flexible chamber is selectively operable within a second temperature range wider than the first temperature range.

4. The refrigerator appliance of claim 3, wherein the first temperature range is between approximately thirty-three degrees Fahrenheit and approximately thirty-eight degrees Fahrenheit and the second temperature range includes temperatures less than thirty-two degrees Fahrenheit.

5. The refrigerator appliance of claim 3, wherein the first temperature range is between approximately thirty-three degrees Fahrenheit and approximately thirty-eight degrees Fahrenheit and the second temperature range includes temperatures greater than forty degrees Fahrenheit.

6. The refrigerator appliance of claim 1, wherein the flexible chamber extends along the vertical direction from a bottom of the door to a top of the door.

7. The refrigerator appliance of claim 1, wherein the door is a first fresh food chamber door, further comprising a second fresh food chamber door mirrored with the first fresh food chamber door whereby the first fresh food chamber door and the second fresh food chamber door cooperatively sealingly enclose the fresh food chamber when the first fresh food door is in the closed position and the second fresh food door is in a closed position, the second fresh food door comprising a dispenser recess in an exterior side of the second fresh food chamber door, the second fresh food chamber door defining a height along the vertical direction and the dispenser recess defining a height along the vertical direction, and wherein the height of the dispenser recess is at least about one-quarter of the height of the second fresh food chamber door.

8. The refrigerator appliance of claim 7, further comprising an ice making assembly positioned within a sub-compartment on an interior side of the second fresh food chamber door, the ice making assembly in communication with the dispenser recess to provide ice to the dispenser recess.

9. A refrigerator appliance defining a vertical direction, the refrigerator appliance comprising:

a cabinet extending from a top to a bottom along the vertical direction, the cabinet defining a fresh food chamber, the fresh food chamber extending along the vertical direction between the top and bottom of the cabinet, the fresh food chamber also extending between a front portion and a back portion, the front portion of the fresh food storage chamber defining an opening for receipt of food items, the cabinet also defining a freezer chamber extending along the vertical direction between the top and bottom of the cabinet and spaced apart from the fresh food chamber along the vertical direction;

a door rotatably mounted to the cabinet at the front portion of the fresh food storage chamber such that the door rotates between a closed position where the door sealingly encloses the fresh food storage chamber and an open position to permit access to the fresh food chamber, the door comprising an outer casing comprising a thermally insulated wall that defines a flexible chamber, and a front panel rotatably mounted to the outer casing of the door such that the front panel of the door permits access to the flexible chamber when the door is in the closed position;

a sealed system configured for generating chilled air, the sealed system in fluid communication with the fresh food chamber, the freezer chamber, and the flexible chamber to provide the chilled air to the fresh food chamber, the freezer chamber, and the flexible chamber, the sealed system comprising a compressor, a first evaporator in fluid communication with the flexible chamber and in fluid communication with the fresh food chamber, a second evaporator in fluid communication with the freezer chamber, and a fan positioned adjacent the first evaporator;

a first duct providing fluid communication from the evaporator to the fresh food chamber; and a second duct providing fluid communication from the evaporator to the flexible chamber, wherein the first duct and the second duct are mutually isolated, and wherein the fresh food chamber and the flexible chamber are not in fluid communication.

10. The refrigerator appliance of claim 9, wherein the freezer chamber defines a height along the vertical direction, the fresh food chamber defines a height along the vertical direction, and wherein the height of the fresh food chamber is approximately three times the height of the freezer chamber.

11. The refrigerator appliance of claim 9, wherein the fresh food chamber is selectively operable within a first temperature range and the flexible chamber is selectively operable within a second temperature range wider than the first temperature range.

12. The refrigerator appliance of claim 11, wherein the first temperature range is between approximately thirty-three degrees Fahrenheit and approximately thirty-eight degrees Fahrenheit and the second temperature range includes temperatures less than thirty-two degrees Fahrenheit.

13. The refrigerator appliance of claim 11, wherein the first temperature range is between approximately thirty-three degrees Fahrenheit and approximately thirty-eight degrees Fahrenheit and the second temperature range includes temperatures greater than forty degrees Fahrenheit.

14. The refrigerator appliance of claim 9, wherein the door extends between a top and a bottom along the vertical direction and a-between a left side and a right side along a direction perpendicular to the vertical direction, wherein the flexible chamber extends from the bottom of the door to the top of the door and extends from the left side of the door to the right side of the door, wherein the flexible chamber is generally coextensive with the door in at least two directions.

15. The refrigerator appliance of claim 9, wherein the door is a first fresh food chamber door, further comprising a second fresh food chamber door mirrored with the first fresh food chamber door whereby the first fresh food door and the second fresh food door cooperatively sealingly enclose the fresh food chamber when the first fresh food door is in the closed position and the second fresh food door is in a closed position, the second fresh food door comprising a dispenser recess in an exterior side of the second fresh food chamber door, the second fresh food compartment door defining a height along the vertical direction and the dispenser recess defining a height along the vertical direction, and wherein the height of the dispenser recess is at least about one-quarter of the height of the second fresh food chamber door.

16. The refrigerator appliance of claim 15, further comprising an ice making assembly positioned within a sub-compartment on an interior side of the second fresh food chamber door, the ice making assembly in communication with the dispenser recess to provide ice to the dispenser recess.

* * * * *